US007038170B1

(12) United States Patent
Child et al.

(10) Patent No.: US 7,038,170 B1
(45) Date of Patent: May 2, 2006

(54) CHANNELED WARMING BLANKET

(75) Inventors: Andrew D. Child, Moore, SC (US); Karen M. Green, Simpsonville, SC (US); Shawn Davis, Inman, SC (US); Keith M. Blackwell, Duncan, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 11/131,626

(22) Filed: May 18, 2005

Related U.S. Application Data

(60) Provisional application No. 60/643,354, filed on Jan. 12, 2005.

(51) Int. Cl.
*H05B 11/00* (2006.01)

(52) U.S. Cl. ..... 219/212; 219/211; 219/545; 219/528; 219/529; 219/516

(58) Field of Classification Search ..... 219/211–12, 219/545, 528, 529, 516
See application file for complete search history.

(56) References Cited

U.S. PATENT DOCUMENTS

| | | | | |
|---|---|---|---|---|
| 4,031,352 | A | 6/1977 | Oosterberg | 219/212 |
| 4,058,704 | A | 11/1977 | Shimizu | 219/528 |
| 4,061,827 | A | 12/1977 | Gould | 428/368 |
| 4,198,562 | A | 4/1980 | Mills et al. | 219/505 |
| 4,485,296 | A | 11/1984 | Ueda et al. | 219/505 |
| 4,577,094 | A | 3/1986 | Mills | 219/505 |
| 4,598,195 | A | 7/1986 | Matsuo | 219/497 |
| 4,607,154 | A | 8/1986 | Mills | 219/505 |
| 4,633,062 | A | 12/1986 | Nishida et al. | 219/212 |
| 4,656,334 | A | 4/1987 | Endo et al. | 219/212 |
| 4,677,281 | A | 6/1987 | Mills | 219/505 |
| 4,855,572 | A | 8/1989 | Wallgren et al. | 219/444.1 |
| 5,422,462 | A | 6/1995 | Kishimoto | 219/545 |
| 5,484,983 | A | 1/1996 | Roell | 219/545 |
| 5,581,192 | A | 12/1996 | Shea et al. | 324/722 |
| 5,776,609 | A | 7/1998 | McCullough | 428/375 |
| 5,804,291 | A | 9/1998 | Fraser, Jr. | 428/283 |
| 5,824,996 | A | 10/1998 | Kochman et al. | 219/529 |
| 5,837,164 | A | 11/1998 | Zhao | 252/500 |
| 5,861,610 | A | 1/1999 | Weiss | 219/497 |
| 5,902,518 | A | 5/1999 | Khazai et al. | 252/511 |
| 5,916,506 | A | 6/1999 | Breznak et al. | 264/104 |
| 5,952,099 | A | 9/1999 | Asher et al. | 428/370 |
| 5,968,854 | A | 10/1999 | Akopian et al. | 442/132 |
| 5,972,499 | A | 10/1999 | Rodriguez et al. | 428/368 |
| 6,080,690 | A | 6/2000 | Lebby et al. | 442/209 |
| 6,090,313 | A | 7/2000 | Zhao | 252/500 |
| 6,093,908 | A | 7/2000 | Haag | 219/204 |
| 6,160,246 | A | 12/2000 | Rock et al. | 219/545 |
| 6,172,344 | B1 | 1/2001 | Gordon et al. | 219/529 |
| 6,174,825 | B1 | 1/2001 | Dutt | 442/43 |
| 6,215,111 | B1 | 4/2001 | Rock et al. | 219/545 |
| 6,229,123 | B1 | 5/2001 | Kochman et al. | 219/549 |
| 6,242,094 | B1 | 6/2001 | Breznak et al. | 428/373 |
| 6,288,372 | B1 | 9/2001 | Sandberg et al. | 219/544 |

(Continued)

*Primary Examiner*—Shawntina Fuqua
(74) *Attorney, Agent, or Firm*—Terry T. Moyer; Cheryl J. Brickey; Jeffery E. Bacon

(57) ABSTRACT

A warming blanket incorporating channeled areas for accepting heat and sensor wires. The inventive blanket includes an arrangement of seam structures defining channels housing substantially discrete elongate heating and sensing elements arranged in a substantially similar pattern within the blanket interior.

22 Claims, 6 Drawing Sheets

U.S. PATENT DOCUMENTS

| | | | | |
|---|---|---|---|---|
| 6,310,332 | B1 | 10/2001 | Gerrard | 219/505 |
| 6,381,482 | B1 | 4/2002 | Jayaraman et al. | 600/388 |
| 6,497,951 | B1 | 12/2002 | DeAngelis et al. | 428/364 |
| 6,680,117 | B1 | 1/2004 | DeAngelis et al. | 428/372 |
| 6,713,733 | B1 | 3/2004 | Kochman et al. | 219/549 |
| 6,756,572 | B1 | 6/2004 | Lee | 219/505 |
| 6,768,086 | B1 | 7/2004 | Sullivan et al. | 219/494 |
| 6,770,854 | B1 | 8/2004 | Keane | 219/529 |
| 6,786,086 | B1 * | 9/2004 | Hashem | 73/152.41 |
| 2001/0025846 | A1 | 10/2001 | Kochman et al. | 219/545 |
| 2002/0137831 | A1 | 9/2002 | Horibe et al. | 524/439 |
| 2003/0015285 | A1 | 1/2003 | Iwamoto et al. | 156/325 |

* cited by examiner

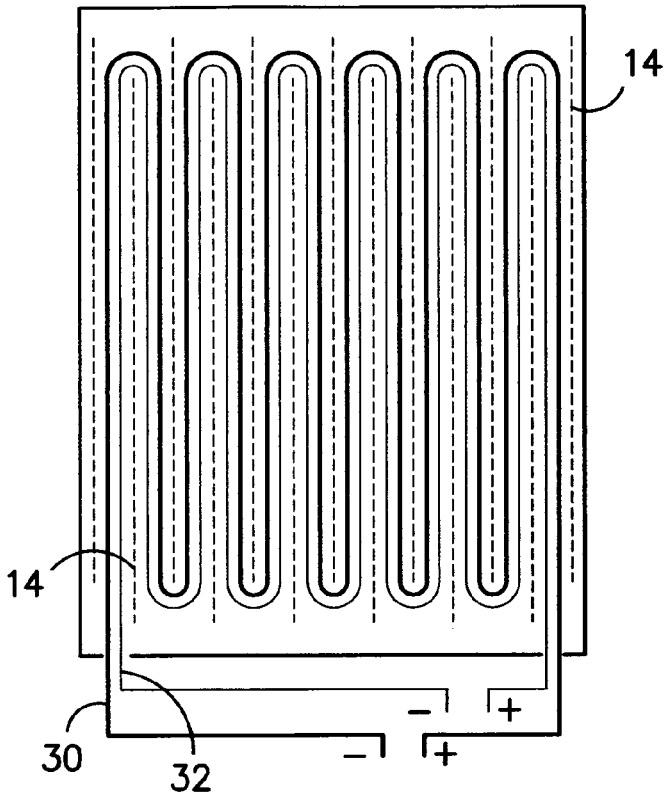
FIG. −4−
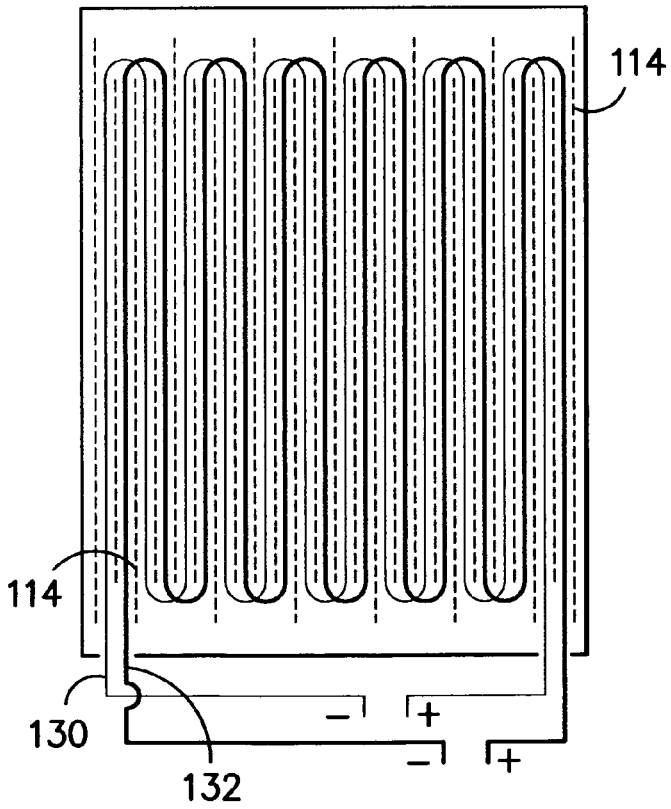
FIG. −5−

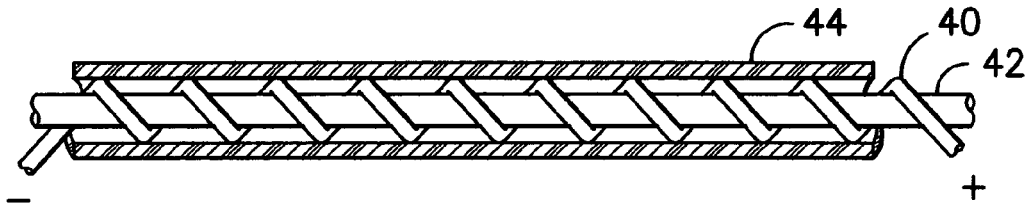
FIG. –6–
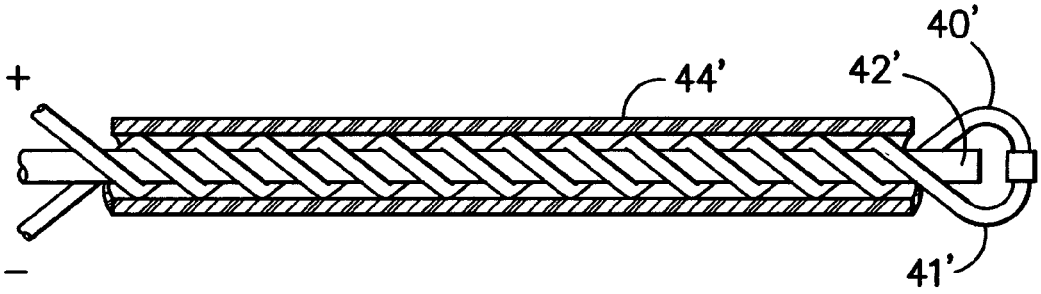
FIG. –7–

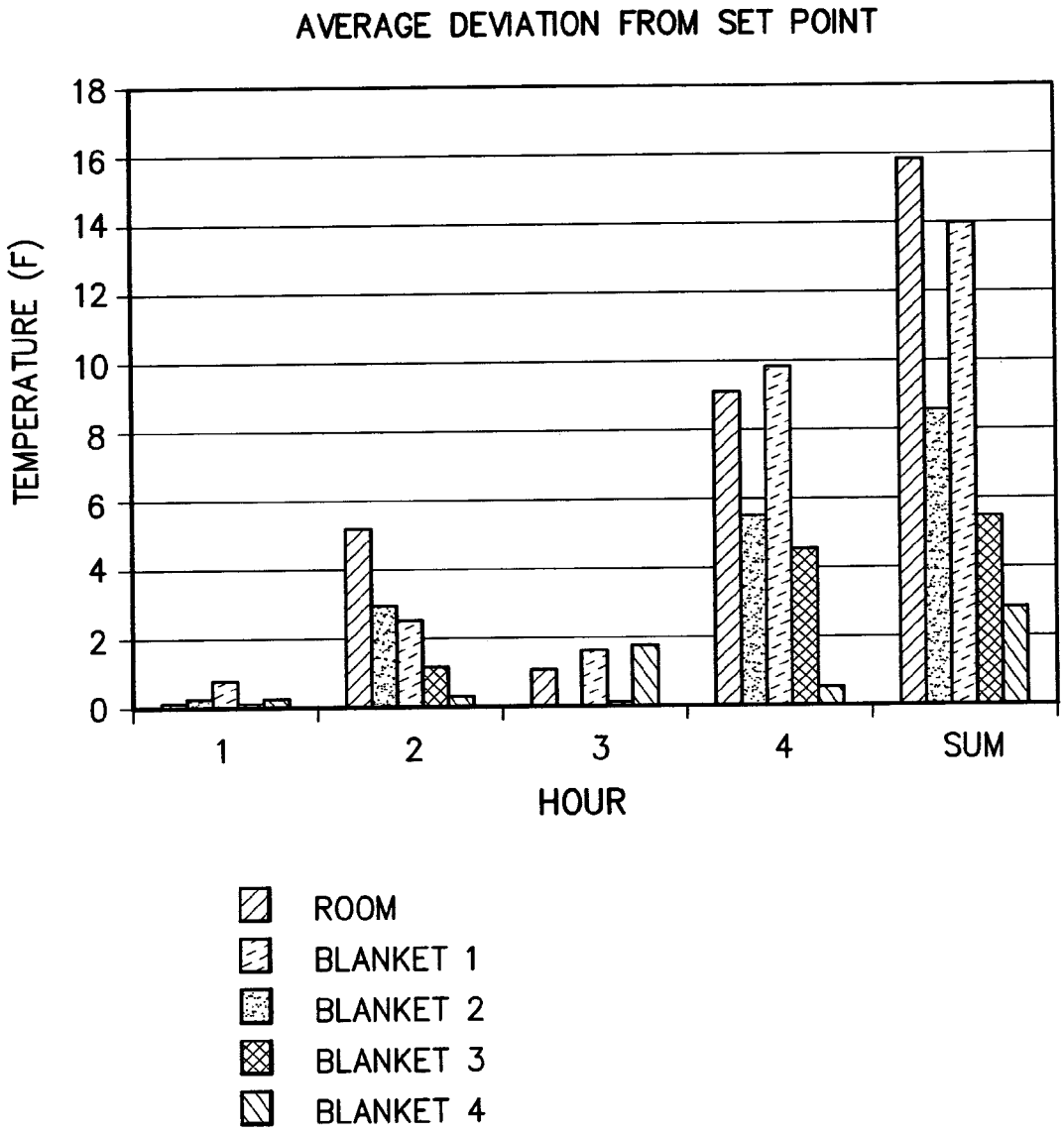
*FIG. —9—*

CHANNELED WARMING BLANKET

CROSS-REFERENCE TO RELATED APPLICATIONS

This application claims the benefit of and priority from U.S. Provisional Application 60/643,354, filed on Jan. 12, 2005 the contents of which are hereby incorporated by reference in their entirety as if fully set forth herein.

TECHNICAL FIELD

This invention relates generally to warming blankets. More particularly, the invention relates to warming blankets including channeled areas for accepting elongate heating and sensor elements. The heating and sensor elements are discrete from one another such that the sensor elements measure the bulk blanket temperature for regulated feedback control of the heating elements. Methods for forming the warming blanket and arranging the heating and sensor elements are also provided.

BACKGROUND

Warming blankets with channels are well known in the art and are available from a variety of sources. Many of these blankets are formed by weaving two layers of cloth simultaneously thereby creating a blanket with a pattern of channels, in which are disposed a single unitary elongate element which incorporates both heating and sensing functions. In the construction of warming blankets it is well known to use wrapped wire constructions in which complementary heating and sensing wires are wrapped around a structural core such as an elongate polymeric fiber or the like. In prior known constructions of this type the heating and sensor wires are disposed within a common insulated covering forming a unitary elongate structure which is then threaded in a desired pattern through channels at the interior of the blanket. The wires may be wrapped concentrically with an insulating sleeve between the wires such as disclosed in U.S. Pat. No. 6,153,856 or in a co-axial arrangement such as disclosed in U.S. Pat. No. 5,861,610 to Weiss. It is also known to use double wrapped wires with either a meltdown layer or temperature coefficient material between the two wires such as described in U.S. Pat. No. 4,742,212 to Ishii. In all of these constructions the heating wire and the sensor wire are ultimately disposed within a common elongate structure surrounded by a common outer insulating sleeve.

In operation of the dual wire constructions, an electrical current is passed through the heating and sensor wires causing the heating wire to increase in temperature. The electrical properties of the sensor wire change with temperature in a predetermined manner. Thus, by monitoring the applied current and voltage across the sensor wire, the temperature of the sensor wire can be determined. Based on the temperature of the sensor wire, the current to the heating wire can then be increased or decreased so as to raise or lower the temperature of the blanket as desired. While such dual wire constructions provide a degree of temperature control under steady state conditions, it has been found that it is difficult to hold the blanket at a substantially steady temperature when the room temperature undergoes a dramatic change. The current applicants hypothesize that such difficulty is due to the overpowering influence of the heating element on the sensor wire housed within the common sleeve structure.

It has been proposed to use a single wire wrapped around a textile core and covered by an insulating sleeve to carry out both the heating and sensing functions. For example, U.S. Pat. No. 6,222,162 to Keane discloses a copper cadmium alloy wire wrapped around a textile core and insulated to form an elongate structure. The insulated structure is channeled into a blanket shell and used for both heating and sensing. It has been found that such single wire constructions may give rise to difficulties in temperature regulation leading to the undesirable possibility of overheating.

It has also been proposed to utilize separate heating and sensing elements arranged in different patterns within the blanket. By way of example, such techniques are disclosed in U.S. Pat. No. 6,768,086 to Sullivan et al., the contents of which are incorporated herein by reference. While such practices may provide the benefit of measuring temperature over an extended area, incorporating the advocated multiple wiring patterns may give rise to an undesirable level of complexity. In particular, the use of distinct complex patterns for the heating and sensor wires may make it difficult to insert and maintain the wires in the desired orientation.

SUMMARY

The present invention provides advantages and/or alternatives over the prior art by providing a warming blanket incorporating substantially discrete elongate heating and sensing elements arranged in a substantially similar pattern within the blanket interior.

According to one contemplated practice the heating elements and sensing elements each incorporate one or more conductive metallic wires such as insulated copper wire or the like in wrapped relation around a core of polymeric fiber or the like with an insulating jacket surrounding the core and wrapped wire. The discrete elongate heating elements and sensing elements are threaded through common channels at the interior of the blanket in a common pattern such that the heating elements and sensing elements run in substantially parallel relation to one another.

According to another contemplated practice the heating elements and sensing elements each incorporate one or more conductive metallic wires such as insulated copper wire or the like in wrapped relation around a core of polymeric fiber or the like with an insulating jacket surrounding the core and wrapped wire. The discrete elongate heating elements and sensing elements are threaded through parallel channels at the interior of the blanket in a pattern such that channel walls separate the heating elements and sensing elements over at least a portion of the pattern.

BRIEF DESCRIPTION OF THE DRAWINGS

The present invention will now be described by way of example only, with reference to the accompanying drawings which constitute a part of the specification herein and in which:

FIG. 4 is an exemplary pattern for threading heating and sensing elements through common channels within a warming blanket;

FIG. 5 is an exemplary pattern for threading heating and sensing elements through discrete channels within a warming blanket;

FIG. 6 is a cut-away view of a wrapped wire construction for use as a heating or sensing element utilizing a single wire wrapped around a fiber core;

FIG. 7 is a cut-away view of a wrapped wire construction for use as a heating or sensing element utilizing two wires wrapped around a fiber core;

FIG. 9 is a bar chart illustrating comparative performance of various blanket constructions in holding a steady temperature during variations of room temperature.

DETAILED DESCRIPTION

Figure 1:
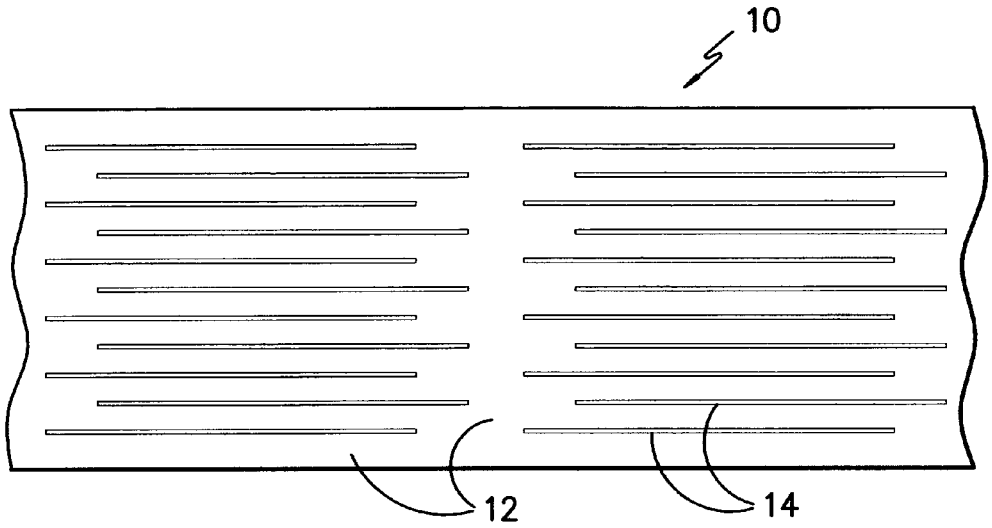
FIG. 1 is an overhead view of an exemplary warming blanket composite showing a channel pattern.

Exemplary embodiments of the invention will now by described by reference to the drawings wherein like elements are designated by corresponding reference number throughout the various views. All referenced patent documents are hereby incorporated by reference as if fully set forth herein. Referring now to the figures, in FIG. 1, a warming blanket shell structure 10 is shown incorporating a pattern of channels 12 defined between elongate seam structures 14. The elongate seam structures 14 preferably connect together layers within the shell structure 10 so as to define a pattern of barrier walls between the channels 12. The seam structures 14 may be of any suitable construction including woven seams, sewn seams, adhesive seams, welded seams and the like. Ultrasonic welded seams and adhesives such as curable urethane or the like may potentially be preferred.

Figure 2:
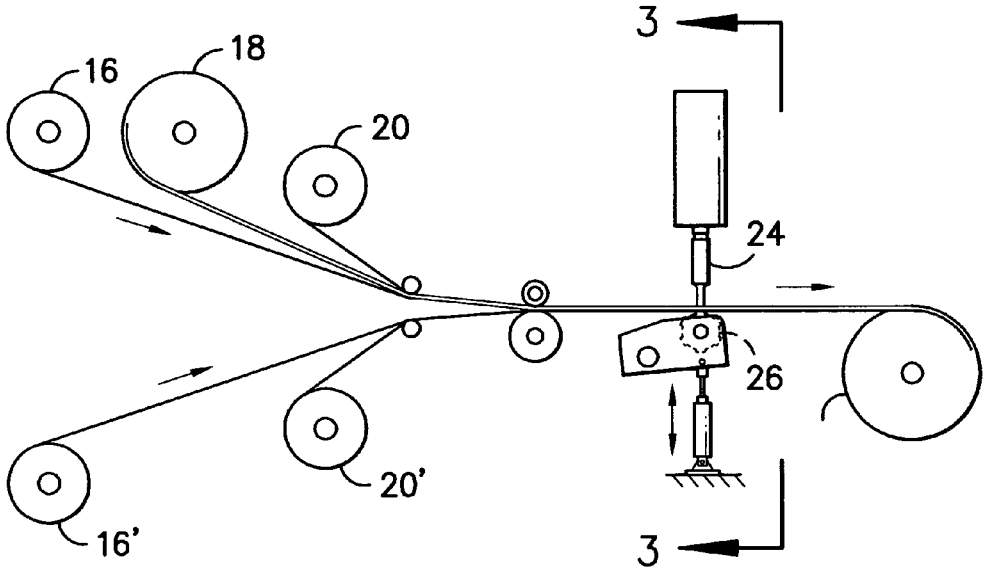
FIG. 2 is a schematic view illustrating an exemplary formation line for applying a channel pattern to a multi-layer warming blanket.

One practice for forming a potentially desirable shell structure incorporating ultrasonic seams is illustrated in FIG. 2. In the illustrated arrangement, let-off rolls are arranged such that two non-woven inner layers 16 and 16' are brought together in adjacent opposing relation to one another. The inner layers 16 and 16' are preferably of non-woven fibrous construction and more preferably of spun-bond non-woven fibrous construction. In a potentially preferred practice the inner layers 16, 16' may be formed of fibers including polyester, polypropylene, or any other ultrasonically fusible fiber material. Although the weight of the inner layers can vary greatly, the layers should be of sufficient strength to provide a stable channel for wiring without increasing the composite stiffness significantly. Preferably, the mass per unit area of each of the inner layers 16, 16' is between about 0.40 oz/yd$^2$ and about 1.1 oz/yd$^2$. This provides a low stretch, low friction channel through which to insert the wire.

In the illustrated practice, a batting layer 18 is delivered to the outside of one or both of the non-woven layers with decorative shell fabrics 20 and 20' on either side of the entire composite to provide a decorative exterior. It is contemplated that the shell fabrics are preferably warp knit, circular knit, nap knit micro-denier, woven, non-woven or needle punch construction formed from suitable ultrasonically fusible fibrous materials including polyester, polypropylene or the like. Although the weight can vary over a wide range, the amount of material affects the ultrasonic welding speed and efficiency. The preferable mass per unit area for the decorative shell fabric layer is in the range from about 2.5 oz/yd$^2$ to about 6.0 oz/yd$^2$. The batting layer 18 is preferably a relatively high loft material for thermal insulation. In this particular example, the outer shell fabric layer 20 defines the top of the blanket so that the batting traps the heat generated and radiates such heat downwards towards the user. Furthermore, the batting is particularly useful in creating both a three-dimensional structure to the final composite and in masking the tactile perception of the heating wires by the user. The batting is preferably a polyester resin-bond with a loft of between 0.125 inches and 0.50 inches. It should have adequate wash stability, and should not contribute to the overall flammability of the composite.

In the illustrated process the layers proceed through a gap between an array of ultrasonic horns 24 and a series of rotating anvils 26. One anvil wheel is provided for each channel boundary and the anvils can be individually actuated in an up and down motion. When an anvil is in the "up" position, the horns direct the relatively high frequency ultrasonic vibration onto the fabric layers held in close proximity by the supporting rotating anvils causing localized frictional heating along a narrow, relatively continuous band and concomitant welding to form a seam. When the anvil is in the "down" position, the fabric layers pass through with no welding occurring. In order to promote flexibility the anvil wheels preferably apply a brick or dot pattern or the like in a manner as will be well known to those of skill in the art.

Figure 3:
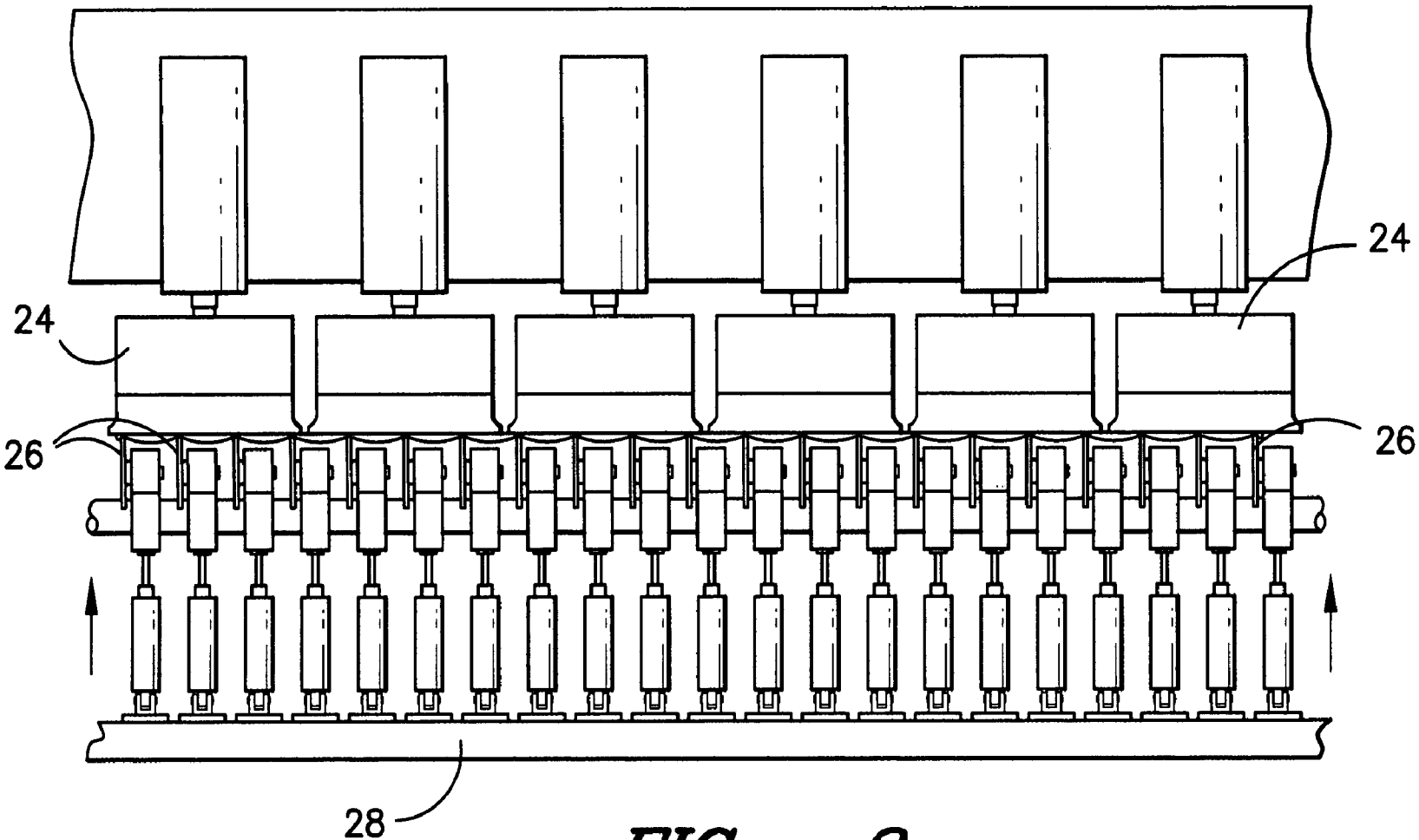
FIG. 3 is a cross machine view taken along line 3—3 in FIG. 2.

In the event that the process of FIG. 2 is utilized, the anvils can be computer controlled to create a pre-determined pattern with a repeat length that is programmable into the controller. Thus, conventional warming blanket design which necessitates channel termination prior to reaching the edge of the blanket shell to allow for normal electrical connections is easily achieved. Blankets of any length can be produced, and blankets of different lengths can be produced on the same equipment with only minor changes to the program. In addition, the anvils 26 are attached to a frame 28 (shown in FIG. 3) and can be positioned across the frame with variable spacing. Thus, the number of channels, the spacing between the channels, and the length of each individual channel can be adjusted without major equipment modifications in a timely and cost effective manner. This method of production allows the blanket composite to be manufactured in roll form, thus avoiding the costly and labor intensive cut and sew steps required with the production of individual blankets. Moreover, automated wiring equipment is more easily employed if the composite is in roll form.

Of course, it is to be understood that the described practice and resulting structures are exemplary and explanatory only and are susceptible to numerous variants. Thus, while such practices and structures may be desirable, the invention is in no way limited to such particular embodiments. By way of example only, according to one contemplated variation the inner layers 16, 16' may be ultrasonically welded to form channels for heat/sensor wires. Subsequently, the outer decorative fabric layers 20, 20' may be attached to the fused non-woven layers by any attachment means available to those in the art.

It is also contemplated that ultrasonic seaming may be eliminated entirely or partially such that at least a portion of the seam structures 14 are formed from techniques such as interweaving, sewn seams, adhesives and the like. Of course, to any extent that ultrasonic welding is eliminated, the need to select materials suitable for such welding techniques is likewise eliminated. It is also contemplated that the inner layers 16, 16' and/or the batting layer 18 may be eliminated or replaced with other suitable materials if desired.

Regardless of the formation technique or layer pattern utilized, the resulting shell structure 10 is preferably characterized by a predefined pattern of channels through which elongate heating and sensor elements may be threaded. A first exemplary arrangement of channels containing a patterned arrangement of elongate heating and sensor elements is illustrated in FIG. 4. As shown, in this construction the seam structures 14 run in parallel relation to one another in the length direction of the blanket. The seam structures 14 define boundaries for interior channels through which a discrete elongate heating element 30 and a discrete elongate sensing element 32 are threaded in a desired pattern such as the illustrated arrangement. In the illustrated construction the elongate heating element 30 and the elongate sensing element 32 follow a common pattern thereby remaining substantially parallel to one another while extending through common channels. If desired, the elongate heating element 30 and the elongate sensing element 32 may cross at localized points such as where they reverse direction at the top and bottom of the pattern while nonetheless maintaining a common pattern.

A second exemplary arrangement of channels containing a patterned arrangement of elongate heating and sensor elements is illustrated in FIG. 5 wherein elements corresponding to those previously described are designated by like reference numerals increased by 100. As shown, in this construction a higher concentration of seam structures 114 is utilized with the elongate heating element 130 and the elongate sensing element 132 running through separate channels separated by the seam structures 114. Thus, while the elongate heating element 130 and the elongate sensing element 132 utilize the same pattern running from end to end of the blanket, there is a slight phase shift between the two patterns. Physical separation between the elongate heating element 130 and the elongate sensing element 132 is maintained by the seam structures 114. Thus, as with the embodiment of FIG. 4, the elongate heating element 130 and the elongate sensing element 132 are disposed in substantially parallel relation to one another with the channels. As shown, the elongate heating element 130 and the elongate sensing element 132 may cross at localized points such as where they reverse direction at the top and bottom of the pattern while nonetheless maintaining the desired common pattern.

Although they perform different functions, the elongate heating element and the elongate sensing element may be of substantially similar construction. By way of example only, and not limitation, constructions for such elongate elements are illustrated in FIGS. 6 and 7. In the construction illustrated in FIG. 6, a single conductive metallic wire 40 such as copper or the like extends in wrapped relation around a flexible core 42 such as a polymeric fiber or the like. The metallic wire 40 may be formed of any suitable material including copper, copper alloys, and other ferrous and nonferrous metals including nickel, steel, and the like. According to one contemplated practice, the metallic wire 40 may be a copper alloy wire such as is available from Fisk Alloy having a thickness of about 33 to about 42 American wire gauge (awg). The metallic wire 40 may be wrapped around a PET textile core having a linear density of about 500 to about 1000 denier. An insulating layer 44 such as PVC or the like extends in surrounding relation to the wrapped structure. It has been found that elongate structures of such construction exhibit substantial flexibility without undue levels of strain hardening so as to permit their insertion in a desired pattern without undue strain hardening and embrittlement. If desired, the metallic wire 40 may also include a nonconductive coating such as enamel or the like. However, metallic wires without such coating may also be utilized if desired.

In the construction illustrated in FIG. 7, a pair of conductive metallic wires 40', 41' such as previously described extends in wrapped relation around a flexible core 42' such as a polymeric fiber or the like. In all other respects the structure is substantially identical to that of FIG. 6. Such structures exhibit substantial flexibility with sufficient structural stability to be threaded through channels within the blanket. A potential benefit is that the two wires may be connected together at one end of the structure as shown thereby completing a circuit so that only one end of the elongate structure needs to be available to the heating or sensing circuit.

Figure 8:
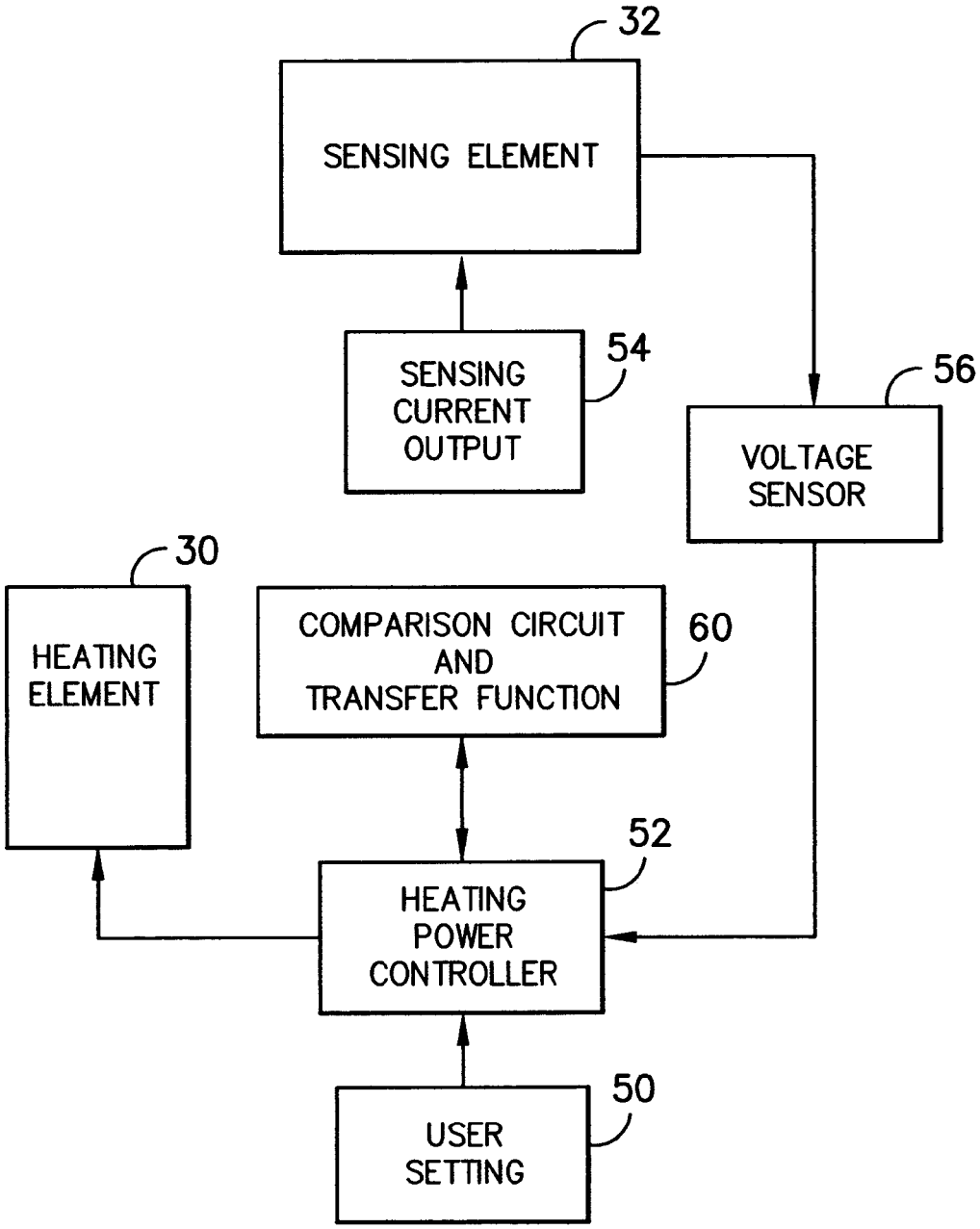
FIG. 8 is a diagram representing operation of the warming blanket.

As illustrated in FIG. 8, according to one contemplated practice, a user will connect the system to a power source and select a desired user setting 50 such as a dial setting of 1 to 10 or specific desired temperature to activate the system. A signal is sent from the user setting 50 to a heating power controller 52 for delivery of current to the heating element 30, 130. In conjunction with activation of the system, a sensing current output 54 is delivered to the elongate sensing element 32, 132. During application of the sensing current a voltage sensor measures the voltage across the sensing element and transmits that data to the heating power controller. Based on the known sensing current output and the measured voltage across the sensing element, the heating power controller calculates the temperature of the sensing element based on a comparison circuit and transfer function 60 and/or a look-up table programmed into the controller. Based on the measured temperature of the sensing element, the heating power controller then adjusts the current flow to the heating element as necessary to achieve the selected user setting. This process is performed continuously to achieve and maintain a desired steady state temperature.

As previously indicated, in the present invention the elongate heating element 30, 130 and elongate sensing element 32, 132 are substantially discrete from one another rather than being contained within a common elongate structure. However, they are nonetheless arranged in a common pattern in substantially parallel relation to one another within the blanket. The use of such discrete heating and sensing elements arranged in common patterns with one another has been shown to provide a dramatically improved ability to maintain a steady state temperature within the blanket as the room temperature changes.

In order to demonstrate the benefits of the present invention, temperature data was collected on blankets with different wiring arrangements within a temperature controlled room. The test blankets were identical to one another in all respects except for the wiring. The test blankets were set at an initial setting and left at that setting throughout the test. The room temperature was cycled from an initial set point of 75 degrees Fahrenheit. The first hour was at 75 degrees Fahrenheit, the next hour the room temperature was reduced to 65 degrees Fahrenheit, then increased back to 75 degrees Fahrenheit, and finally increased to 85 degrees Fahrenheit. Blanket temperature was measured throughout the test to see how well the blanket sensed the room temperature and then responded. The test samples were: (1) a commercial warming blanket having a heating and sensor wire arranged in a common sleeve running in a sinusoidal pattern, (2) a warming blanket that is believed to be formed according to the teachings in U.S. Pat. No. 6,686,561, (3) a warming blanket incorporating separate discrete elongate heating and sensing elements arranged through common interior channels in a pattern as shown in FIG. 4, and (4) a warming blanket incorporating separate discrete elongate heating and sensing elements arranged through separate interior channels in a pattern as shown in FIG. 5.

Performance was evaluated based on the deviation of the blanket temperature from the initial set point of 75 degrees Fahrenheit. A perfect blanket would have the same temperature regardless of what the room temperature was resulting in a value of zero deviation. A blanket with poor temperature control would substantially follow room temperature and have approximately the same value of deviation as the room. FIG. 9 is a bar chart showing the average deviation values for the room and for each blanket relative to the initial 75 degree Fahrenheit at the different time points, and a final summation of the deviations. The summation of the deviations is believed to be the clearest identifier of the blanket performance. As demonstrated, blankets 3 and 4 provided superior performance in maintaining a steady temperature when subjected to changes in room temperature with blanket 4 providing the best results of any blanket tested.

While the present invention has been illustrated and described in relation to certain potentially preferred embodiments and practices, it is to be understood that the illustrated and described embodiments and practices are illustrative only and that the present invention is in no event to be limited thereto. Rather, it is fully contemplated that modifications and variations to the present invention will no doubt occur to those of skill in the art upon reading the above description and/or through practice of the invention. It is therefore intended that the present invention shall extend to all such modifications and variations as may incorporate the broad aspects of the present invention within the full spirit and scope of the invention.

The invention claimed is:

1. A warming blanket, comprising:

a first textile panel and a second textile panel operatively joined together by a plurality of seam structures defining an arrangement of channels extending in a pattern between the first textile panel and the second textile panel;

an elongate heating element extending through at least a potion of the channels; and an elongate sensing element discrete from the elongate heating element extending through at least a portion of the channels, wherein the elongate heating element and the elongate sensing element are arranged in substantially common pattern arrangements such that the portions of the elongate heating element and the elongate sensing element within the channels are disposed in substantially parallel orientation to one another.

2. The invention as recited in claim 1, wherein at least one of the elongate heating element and the elongate sensing element comprises a metallic wire disposed in wrapped relation to a textile fiber core with an insulating sleeve disposed in surrounding relation to the wrapped wire and fiber core.

3. The invention as recited in claim 1, wherein each of the elongate heating element and the elongate sensing element comprises a metallic wire disposed in wrapped relation to a textile fiber core with an insulating sleeve disposed in surrounding relation to the wrapped wire and fiber core.

4. The invention as recited in claim 1, wherein at least one of the elongate heating element and the elongate sensing element comprises a pair of metallic wires disposed in wrapped relation to a textile fiber core with an insulating sleeve disposed in surrounding relation to the wrapped wires and fiber core.

5. The invention as recited in claim 1, wherein each of the elongate heating element and the elongate sensing element comprises a pair of metallic wires disposed in wrapped relation to a textile fiber core with an insulating sleeve disposed in surrounding relation to the wrapped wires and fiber core.

6. The invention as recited in claim 1, wherein the elongate heating element and the elongate sensing element extend through common channels.

7. The invention as recited in claim 6, wherein the elongate heating element and the elongate sensing element are arranged in a common sinusoidal pattern.

8. The invention as recited in claim 1, wherein at least portions of the elongate heating element and the elongate sensing element extend through different channels such that seam structures separate said portions of the elongate heating element and the elongate sensing element from one another.

9. The invention as recited in claim 8, wherein the elongate heating element and the elongate sensing element are arranged in common sinusoidal patterns shifted out of phase relative to one another.

10. A warming blanket, comprising:

a first textile panel and a second textile panel operatively joined together by a plurality of elongate seam structures running at least partially along the length of the blanket such that the seam structures define an arrangement of channels extending in a pattern along the length direction of the blanket between the first textile panel and the second textile panel;

an elongate heating element extending through at least a potion of the channels; and an elongate sensing element discrete from the elongate heating element extending through at least a portion of the channels, wherein the elongate heating element and the elongate sensing element are arranged in substantially common wave pattern arrangements such that the portions of the elongate heating element and the elongate sensing element within the channels are disposed in substantially parallel orientation to one another.

11. The invention as recited in claim 10, wherein at least one of the elongate heating element and the elongate sensing element comprises a metallic wire disposed in wrapped relation to a textile fiber core with an insulating sleeve disposed in surrounding relation to the wrapped wire and fiber core.

12. The invention as recited in claim 10, wherein each of the elongate heating element and the elongate sensing element comprises a metallic wire disposed in wrapped relation to a textile fiber core with an insulating sleeve disposed in surrounding relation to the wrapped wire and fiber core.

13. The invention as recited in claim 10, wherein at least one of the elongate heating element and the elongate sensing element comprises a pair of metallic wires disposed in wrapped relation to a textile fiber core with an insulating sleeve disposed in surrounding relation to the wrapped wires and fiber core.

14. The invention as recited in claim 10, wherein each of the elongate heating element and the elongate sensing element comprises a pair of metallic wires disposed in wrapped relation to a textile fiber core with an insulating sleeve disposed in surrounding relation to the wrapped wires and fiber core.

15. The invention as recited in claim 10, wherein the elongate heating element and the elongate sensing element extend through common channels.

16. The invention as recited in claim 15, wherein the elongate heating element and the elongate sensing element are arranged in a common sinusoidal pattern.

17. The invention as recited in claim 10, wherein at least portions of the elongate heating element and the elongate sensing element extend through different channels such that seam structures separate said portions of the elongate heating element and the elongate sensing element from one another.

18. The invention as recited in claim 17, wherein the elongate heating element and the elongate sensing element are arranged in common sinusoidal patterns shifted out of phase relative to one another.

19. A warming blanket, comprising:

a first textile panel and a second textile panel operatively joined together by a plurality of elongate seam structures running at least partially along the length of the blanket such that the seam structures define an arrangement of channels extending in a pattern along the length direction of the blanket between the first textile panel and the second textile panel;

an elongate heating element extending through a first potion of the channels; and an elongate sensing element discrete from the elongate heating element extending through a second different portion of the channels, wherein the elongate heating element and the elongate sensing element are arranged in substantially common sinusoidal wave pattern arrangements shifted out of phase such that the portions of the elongate heating element and the elongate sensing element within the channels are disposed in substantially parallel orientation to one another.

20. The invention as recited in claim 1, wherein the elongate heating element and the elongate sensing element are continuous.

21. The invention as recited in claim 1, wherein the elongate heating element contains no electrical connections or electrical intersections with another heating element or sensing element within the blanket.

22. The invention as recited in claim 1, wherein the elongate sensing element contains no electrical connections or electrical intersections with another sensing element or heating element within the blanket.

* * * * *